US009969600B2

(12) United States Patent
Fenker et al.

(10) Patent No.: US 9,969,600 B2
(45) Date of Patent: May 15, 2018

(54) REMOTE-CONTROLLED CRANE

(71) Applicant: Liebherr-Components Biberach GmbH, Biberach an der Riss (DE)

(72) Inventors: Oliver Fenker, Warthausen (DE); Roman Hofmann, Wangen (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 163 days.

(21) Appl. No.: 14/880,636

(22) Filed: Oct. 12, 2015

(65) Prior Publication Data

US 2016/0031683 A1 Feb. 4, 2016

Related U.S. Application Data

(63) Continuation-in-part of application No. PCT/EP2014/000732, filed on Mar. 18, 2014.

(30) Foreign Application Priority Data

Apr. 11, 2013 (DE) ..... 10 2013 006 258

(51) Int. Cl.
*B66C 13/40* (2006.01)
*B66C 13/46* (2006.01)
(Continued)

(52) U.S. Cl.
CPC ..... *B66C 13/40* (2013.01); *B66C 13/46* (2013.01); *B66C 23/16* (2013.01); *B66C 13/44* (2013.01);
(Continued)

(58) Field of Classification Search
CPC ..... B66C 1/0256; B66C 1/0275; B66C 13/18; B66C 13/22; B66C 13/23; B66C 13/40;
(Continued)

(56) References Cited

U.S. PATENT DOCUMENTS 5,205,544 A * 4/1993 Kroeger ..... B66C 13/08 254/329
5,580,113 A * 12/1996 Pomerville ..... B66C 1/34 294/82.3
(Continued)

FOREIGN PATENT DOCUMENTS

CN 101723270 A 6/2010
CN 102180410 A 9/2011
(Continued)

OTHER PUBLICATIONS

State Intellectual Property Office of the People's Republic of China, Search Report Issued in Patent Application No. 201480020739.7, dated Apr. 26, 2016, 4 pages.
(Continued)

*Primary Examiner* — Thomas G Black
*Assistant Examiner* — Sara J Lewandroski
(74) *Attorney, Agent, or Firm* — McCoy Russell LLP

(57) ABSTRACT

The present disclosure concerns a crane, in particular a tower crane, telescopic boom crane, harbor crane and the like, with a load hook that can be raised or lowered via movable crane elements, and moved within a crane working area by operating drive units associated with the crane elements. The crane is provided with a control unit with input means to control the drive units. According to the present disclosure, the crane uses a mobile portable target signal transmitter that can be variably positioned in the crane working area, and positioning means for automatically determining the current position of the target signal transmitter relative to the load hook and/or a crane element, and target control means for automatically controlling the drive units in response to a signal from the positioning means, such that the load hook is automatically moved to the mobile target signal transmitter.

5 Claims, 2 Drawing Sheets

(51) Int. Cl.
*B66C 23/16* (2006.01)
*B66C 13/44* (2006.01)
*B66C 13/48* (2006.01)

(52) U.S. Cl.
CPC ..... *B66C 13/48* (2013.01); *B66C 2700/082* (2013.01); *B66C 2700/088* (2013.01)

(58) Field of Classification Search
CPC ..... B66C 13/44; B66C 13/46; B66C 13/48; B66C 13/54; B66C 2700/08; B66C 2700/082; B66C 2700/084; B66C 2700/085; B66C 2700/087; B66C 2700/088; B66D 1/40; B66D 1/48; B66D 1/485
See application file for complete search history.

(56) References Cited

U.S. PATENT DOCUMENTS 5,645,181 A * 7/1997 Ichiba ..... B66C 13/46 212/281
5,823,370 A * 10/1998 Ueda ..... B66C 23/905 212/276
6,931,314 B2 * 8/2005 Holland ..... B65G 63/004 414/139.4
6,965,823 B2 11/2005 Wichner
2001/0050263 A1 * 12/2001 Freeman ..... B66C 13/40 212/179
2002/0011457 A1 * 1/2002 Ducrot ..... B66C 13/22 212/277
2002/0043510 A1 * 4/2002 Bachman ..... B66C 1/34 212/283
2003/0164349 A1 * 9/2003 Kohlenberg ..... B66C 13/40 212/284
2003/0214487 A1 * 11/2003 Morath ..... B66C 13/16 345/173
2004/0073358 A1 * 4/2004 Wichner ..... B66C 13/063 701/124
2005/0192732 A1 * 9/2005 Narisawa ..... B66C 23/905 701/50
2005/0242602 A1 * 11/2005 Protesto ..... B66C 1/36 294/82.21
2007/0272643 A1 * 11/2007 Hailstone ..... B66C 1/105 212/71
2012/0143445 A1 6/2012 Morath
2014/0107971 A1 * 4/2014 Engedal ..... B66C 13/02 702/150
2014/0232208 A1 * 8/2014 Yamaguchi ..... B66C 13/40 307/154
2014/0266875 A1 * 9/2014 Cameron ..... B66C 13/46 342/357.36
2015/0123476 A1 * 5/2015 Mesia ..... B66C 13/28 307/29
2015/0142174 A1 * 5/2015 Ford ..... B66C 13/40 700/275
2015/0249821 A1 * 9/2015 Tanizumi ..... B60R 1/00 348/46
2016/0031681 A1 * 2/2016 Delplace ..... B66C 15/06 345/420
2016/0201408 A1 * 7/2016 Little ..... B66C 1/0287 414/22.55

FOREIGN PATENT DOCUMENTS

DE 10107048 A1 8/2002
DE 102006001279 A1 7/2007
DE 102009016366 A1 12/2009
DE 102008047425 A1 4/2010
DE 102010028395 A1 11/2011
DE 102011120734 A1 6/2012
EP 1806311 A2 7/2007
EP 2383217 A2 * 11/2011 ..... B66C 13/40
EP 2383217 A2 * 11/2011 ..... B66C 13/40
EP 2383218 A2 11/2011
KR 1020110105560 A 9/2011
WO 9745357 A1 12/1997
WO 2010028938 A1 3/2010
WO 2012168041 A1 12/2012

OTHER PUBLICATIONS

State Intellectual Property Office of the People's Republic of China, First Office Action Issued in Patent Application No. 201480020739.7, dated May 5, 2016, 12 pages.
State Intellectual Property Office of the People's Republic of China, Second Office Action and Search Report Issued in Application No. 201480020739.7, dated Dec. 29, 2016, 18 pages.
ISA European Patent Office, International Search Report Issued in Application No. PCT/EP2014/000732, dated Apr. 28, 2014, WIPO, 6 pages.

* cited by examiner

REMOTE-CONTROLLED CRANE

CROSS REFERENCE TO RELATED APPLICATIONS

The present application is a continuation-in-part of PCT International Application PCT/EP2014/000732, entitled "Remote-Controlled Crane," filed on Mar. 18, 2014, which claims priority to German Patent Application No. 10 2013 006 258.6, filed on Apr. 11, 2013, the entire contents of each of which are hereby incorporated by reference in their entirety for all purposes.

TECHNICAL FIELD

The present disclosure relates to a crane, in particular a tower crane, telescopic boom crane, harbour crane and the like, with a load hook that can be raised or lowered by means of movable crane elements, and moved within a crane working area by operating drive units associated with the crane elements. The crane is provided with a control unit with input means to control the drive units.

BACKGROUND AND SUMMARY

In cranes of the said type, the load hook can usually be raised and lowered by means of a hoisting cable that runs from a crane jib and an associated hoisting winch, and in addition it can be moved in a horizontal plane by adjusting movable crane elements, which naturally allows combined movements in several axes to approach different points in the crane working area. For example, in the case of a tower crane, the tower together with the attached jib can be turned about a vertical axis with a slewing drive, and a trolley on the jib can be moved with a traversing trolley to move the load hook into the desired position. In case of a crane with a luffable telescopic jib, the jib can be luffed up or down and telescoped in or out to adjust the overhang of the load hook, whereby the turntable carrying the jib can be turned about a vertical axis to move the boom position together with the load hook into the desired position. Depending on the type of crane, corresponding movable crane elements are moved by these assigned drive units to move the load hook to the desired point in the crane working area.

On the one hand, it is known on construction sites to control the movable crane elements from the cab via the input means of the control unit in the cab, for example with a joystick, to control and operate the drives, moving the load hook to the desired location. The crane operator, with his experience and his good sense of judgement, estimates the path to be travelled and intuitively operates the drive units as necessary. Alternatively or additionally, it is also known on construction sites to operate the crane not from the cab but by means of radio remote control. In that case, the crane operator is on the construction site and follows the crane hook to the marked load, and when the hook reaches its target, he attaches the load and has it moved into the desired position. Controlling the drive units via input means of the radio remote control has the advantage that the crane operator is much closer to the crane hook to be moved, and when it approaches the load or the load placement area, he can see the load to be picked up or the spot where the load hook is to place the load, much more accurately, which enables him to control the drive units more sensitively. However, operating the remote control requires some practice, since depending on where the crane operator stands with the remote control in relation to the crane, the rotational axes of the joystick of the remote control can be skewed in relation to the actual axes of movement.

DE 10 2008 047 425 A1 describes a crane with a radio remote control, where it is determined by means of a distance meter whether the radio remote control is in a pre-defined ring around the crane, and the radio remote control should be blocked when it is outside that ring. This is to prevent the crane operator's feet being caught under the outriggers of the crane when it is lowered, or prevent him from standing too far away from the crane to watch the lowering of the feet closely enough. However, the above named problem remains unsolved, namely the inability to approach a load or a drop-off point with enough precision.

DE 10 2011 120 734 A1 also describes a crane that is controllable with a mobile remote control. It provides for a release function for the remote control with which the crane operator must assume a pre-defined and safe position to perform a certain crane movement with the remote control. For this purpose, several transponders are provided on the crane which release the remote control when the operator approaches at a certain distance. If, for example, the crane operator wants to extend the outriggers on the right side of the crane, he must take the remote control to a certain transponder on the crane or near it, which keeps the crane operator at a safe distance.

DE 10 2006 001 279 A1 describes a tower crane with a trolley movable on the jig whereby a transmitter/receiver on the trolley communicates on the one hand with a transponder fastened to the load and on the other hand with a transponder rigidly mounted at the construction site. Through communication with the first transponder, pendulum movements of the load in relation to the trolley can be determined, or if these movements stop, it can be determined that the load has been set down. Communication with the second transponder allows to determine the trolley position and thus the actual unloading of the load, such that the load torque applied upon the crane can be determined together with the known load weight. When a predetermined limit is exceeded, corresponding crane movements can be prevented. However, this also does not solve the above mentioned problem, namely to find a simple way to move the load hook to a certain location with precision.

The object of the present disclosure therefore is to provide an improved crane of the kind described above, which does not have the disadvantages of the state of the art and develops the crane advantageously. In particular to be simplified is the precise controlled approach of a load or of the load hook approaching a drop-off point.

According to the present disclosure, in one example, the object is achieved by means of a crane comprising a load hook; movable crane elements for raising or lowering the crane within a crane working area via operating of associated drive units; and a control unit with an input device, a mobile portable target signal transmitter, a positioning device, and a target controller, the control unit including computer-readable instructions stored on non-transitory memory for: controlling the drive units based on operator input received at the input device; variably positioning the mobile portable target signal transmitter within the crane working area; determining, via the positioning device, a current position of the target signal transmitter relative to the load hook and/or one of the movable crane elements; and automatically controlling the drive units via the target controller in response to a signal from the positioning device such that the load hook is automatically moved to the mobile target signal transmitter.

It is proposed to automate the approach of a load hook to a certain target point in the crane working area. The crane operator can predetermine a target point or a target point signal and trigger the automatic approach to this target point whereby the drive units of the crane no longer have to be manually operated or controlled by the crane operator, but are automatically steered by the crane control system. According to the present disclosure, the crane uses a mobile portable target signal transmitter that can be variably positioned in the crane working area, a positioning device for automatically determining the current position of the target signal transmitter relative to the load hook and/or a crane element, and a target controller for the automatic steering of drive units in response to a signal of the positioning means, such that the load hook is automatically moved to the mobile target signal transmitter. The automatic move of the target signal transmitter with the load hook can be fully automatic such that the crane performs the corresponding crane movements when the portable signal transmitter is moved, such that the load hook is following the mobile target signal transmitter like a dog, or the crane operator walking across the construction site with the target signal transmitter. Alternatively to such a fully automatic load hook control, the desired target position can also advantageously be approached semi-automatically, such that the crane operator has to release the movement before the crane control performs the movement of the load hook or automatically steers the drive units accordingly. The crane operator can walk to the desired target point with the portable target signal transmitter and then, for example by activating a switch or input device on the radio remote control, trigger the automated load hook movement while the crane operator does not have to manually control the individual drive units such as the slewing unit, the traversing trolley or the hoisting winch, with the joy stick or similar device, but the necessary drive movements are automatically controlled by the control unit.

In the further development of the present disclosure, the portable target signal transmitter can be integrated in the portable remote control or the portable control panel with which the crane operator can control the crane outside the crane's cab or control stand. This allows the crane operator to simply predetermine the target position or the target point signal by walking ahead of the load hook with the remote control or walk to the desired target point. Alternatively to such an integration in the mobile control panel, the system can be further developed in that the portable target signal transmitter can also be an external device such as a separate portable component, for example in the form of a necklace or a watch-like unit to be worn by the crane operator. Alternatively or additionally, the portable target signal transmitter can also be a unit directly attachable to the load with suitable fasteners such as magnets, clips or other such positively connectable fasteners, whereby the fasteners are preferably detachable and can be re-used at different target points, for example at load placement locations or on loads to be picked up. In each case, the portable target signal transmitter may be communicatively coupled to the portable control panel, such as via a network, via wireless transmission, or radio transmission.

In principle, the mobile target signal transmitter can be of variable design and communicate with the positioning means in variable ways. According to one example of the present disclosure, the portable target signal transmitter can be designed as a transponder or radio signal transmitter and communicate with the positioning means via radio data transmission. The transponder can be of passive mode, such that it transmits a certain answer signal only when it receives a signal from the positioning means. However, alternatively, the transponder can also be of active mode, and transmit a transponder signal to the positioning means of its own, i.e., without receiving a call signal.

When a transponder is used as a target signal transmitter, the positioning device can comprise a suitable transponder tracking arrangement for tracking the transponder. For example, such a transponder tracking arrangement can comprise several transmitting/receiving modules spaced apart from each other on the crane, in particular on a crane jib, to communicate with the transponder of the portable target signal transmitter, whereby an evaluation arrangement evaluates the received transponder signals with regard to certain signal characteristics to determine the position of the transponder relative to the transmitting/receiving modules. In particular, the said evaluation arrangement can determine a signal propagation delay, such as the time span from emitting a call signal to receiving a transponder reply signal, for the various transmitting and/or receiving modules on the crane, using these to determine the distance of the transponder from the various receiving modules and hence the position of the target signal transmitter relative to the crane. Alternatively or additionally, the transponder tracking arrangement or its evaluation arrangement can also use or consider a signal strength of the transponder signals received from the transponder of the target signal transmitter to determine the distance from the receiving modules on the crane and hence the position of the transponder.

The tracking arrangement can work like radio cell tracking as it is known with mobile telephones, where the signal communication is evaluated with several transmission/receiving units.

Alternatively or additionally to such transponder tracking, the target signal transmitter can also comprise a global positioning system (GPS) unit, in particular a GPS signal receiver which determines the current position of the target signal transmitter from a global satellite-based positioning system and transmits a corresponding position signal to the crane's positioning device. Advantageously, the crane's positioning device can also be equipped with such a GPS unit or a GPS signal receiver to determine the position of the crane or a crane element such as the crane base or trolley in the same coordinate system as the GPS position of the target signal transmitter, such that the relative position of the target signal transmitter and the crane can be determined from which the crane control can calculate the path to be followed and direct the drive units accordingly to move the load hook to the target signal transmitter position. In one example, the crane's positioning device itself may not have such a GPS signal receiver. If the GPS coordinates of the crane location are known, they can also be entered manually in the crane control or imported by it in a suitable manner.

Alternatively or additionally to such a GPS signal generator, the target signal transmitter can also provide an optical target signal, for example in the form of a light signal such as a light beam or in the form of an optical marker, for example in the form of a target ring structure. The positioning device provided on the crane may comprise a camera or other suitable optical sensors, to determine the position of the optical marker relative to the crane. From this determined relative position the automatic movement of the load hook to the target position may be automatically controlled and the drive units may be activated accordingly.

Alternatively or additionally to such a portable target signal transmitter, according to another aspect of the present disclosure, a target point can also be reached or an appropriate target point signal can also be provided by virtually presenting the crane travel area and the marking that can be provided for a certain place inside this area. According to the present disclosure, the crane can comprise a display arrangement for displaying a graphic presentation of the crane working area, whereby the display arrangement is provided with a marking device to mark a target point to be reached in the graphic presentation, and a positioning device to determine the position of the marking relative to the load hook and/or another crane element, such that the target controller automatically steers the drive units subject to a signal from the positioning device, such that the load hook is automatically moved to the marked target point of the display or to the actual target point in the crane working area that corresponds to the marking in the display.

Advantageously, one such display arrangement can be provided in the radio remote control or mobile control panel of the crane, whereby the radio remote control of the control panel can advantageously comprise a touch display on which the crane working area can be displayed, for example, in the shape of the construction site, such that the crane operator, by touching a desired point on the display, can set the target point and generate the corresponding target point signal. Alternatively or additionally, such a display can, of course, also be provided in the crane's cab.

Below, the present disclosure is more closely described by means of example embodiments elaborated with reference to the figures.

DETAILED DESCRIPTION

Figure 1:
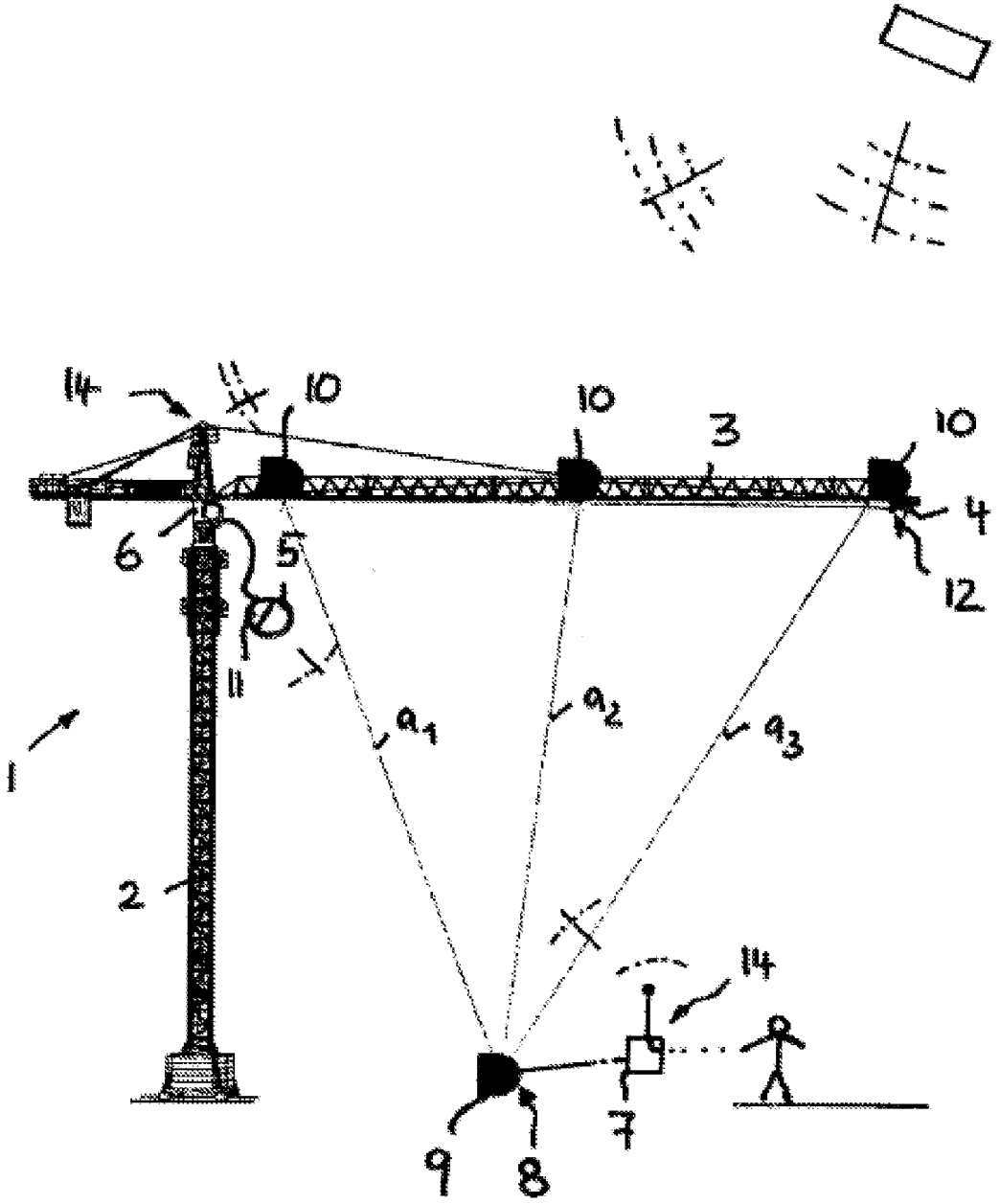
FIG. 1 shows a schematic view of a crane in the form of a tower crane according to an example embodiment of the present disclosure, in which a target signal transmitter is integrated into a radio remote control or mobile control panel of the crane operator, such that the crane with its load hook can be automatically moved to the position of the crane operator or the mobile control panel.
Figure 1:
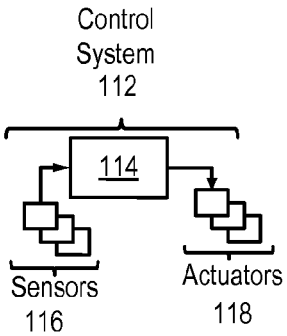

As FIG. 1 shows, crane 1 can be designed as a tower crane whose tower 2 carries a jib 3 on which a trolley 4 is movably mounted. Jib 3 can be rotated about a vertical axis together with or without tower 2, depending on whether the crane is designed as a top slewing or bottom slewing crane, with a slewing drive that is provided. Jib 3 could also be designed to be luffable up and down around a recumbent transverse axis, whereby a suitable luffing drive could be provided that interacts, for example, with the jib bracing. The said trolley 4 can be moved by a trolley winch or another trolley drive. The said drive units are controlled by a control unit 5 which can comprise a stationary control panel with a suitable input device such as in the form of joy sticks in the crane operator's cab 6 or at the control stand of the crane.

In addition to such a stationary control panel, crane 1 advantageously comprises a mobile control panel 7, for example in the form of a radio remote control which the crane operator can wear as he walks across the construction site in the crane working area of crane 1 to control crane 1 from outside the crane operator's cab 6.

Advantageously, the mobile control panel 7 also comprises a portable target signal transmitter 8 which can include a transponder 9 that communicates with the crane. As an example, three or more transmitting/receiving units 10 or transponders can be provided on crane 1, for example on its jib 3, each of which communicate with the mobile control panel 7. The positioning device 11 in the control unit 5 of the crane comprises a tracking arrangement with a suitable evaluation unit to determine the position of the target signal transmitter 8 relative to crane 1 from the transmitted transponder signals. For example, the above described method can be used to measure the signal propagation delay of a signal between transponder 9 and transmitter/receiver units 10 and to determine from this the distance a1, a2 and a3 from transponder 9 to the individual transmitting/receiving units 10; as shown at FIG. 1. By means of the said three distances a1, a2 and a3, the position of the target signal transmitter 8 and thus the mobile control panel 7 relative to the crane can be determined, such that the crane operator, who is wearing the mobile control panel 7, can predetermine the moving position for the load hook 12. For example by activating a switch, "automatic load hook movement" on the mobile control panel 7, the crane operator can start the move into the target position. For this, the control panel 5 steers the drive units of the crane such that the load hook 12 moves in the direction of the desired target position.

Since the crane position at the construction site or in the working area is known, the said transmitting/receiving unit 10 can also be firmly mounted at the construction site or in the crane working area, thus determining the position of the target signal transmitter 8 at the construction site. From this positioning, the crane can calculate—with its own known position—the relative position of the target signal transmitter 8 and therefore move the load hook 12 into the target position.

As FIG. 1 shows as well, the mobile control panel 7 can also comprise a GPS signal receiver 14 which receives corresponding coordinates from a satellite-based global positioning system and transmits them to the control panel 5 of crane 1. The control panel 5 of crane 1 can also itself comprise a corresponding GPS signal receiver 14 to match the GPS coordinates of the mobile control panel 7 to crane 1, subject to which the load hook 12 can then automatically move to the target position as described.

Crane 1 of FIG. 1 may further comprise a control system 112. The control system 112 may include a processor and memory 114, in combination with sensors 116 and actuators 118, to carry out the various controls described herein. Example sensors may include GPS sensors and transponders coupled to the crane. Example actuators may include for example various motors (e.g., electric motors), various valves (e.g., electric valves and/or hydraulic valves), and various pumps (e.g., electric and/or hydraulic pumps) of the crane drive units, as well as those coupled to steering drive units and luffing units of the crane. Still other actuators may include the target signal transmitter, the load hook, and various trolleys coupled to the crane jib. In one example, control system 112 may be coupled to control panel 5 in a crane control system. The control system 112 may include, or be communicatively coupled to, one or more steering drive units. In one example, the steering drive units may be configured as joysticks. The control system receives signals from the various sensors of FIG. 1 and employs the various actuators of FIG. 1 to adjust crane operation based on the received signals and instructions stored on the memory of the control system. As one example, based on the signals transmitted to and received at the transponders, the control system may adjust the operation of the various motors and valves of the crane drive units. For example, in response to the signals, the control system may determine a target position for the load hook within a crane working area relative to a current position and accordingly control (e.g., increase) the output of a hydraulic pump and the position of a valve in a hydraulic line delivering hydraulic fluid to the crane drive unit. As a result of the actuation, there may be increased delivery of hydraulic fluid to the fluid line of the crane drive units, enabling the drive units to provide tractive force to the crane jib, allowing for the movement (e.g., telescoping or raising/lowering) of the crane jib, and movement of the load hook (e.g., raising or lowering). In an alternate example, an electric motor coupled to the crane drive unit may be operated in response to the signals received at the transponders and operation of the electric motor may provide the crane drive unit with sufficient tractive force for moving the crane jib and/or load hook.

It will be appreciated that FIG. 1 shows example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example.

Figure 2:
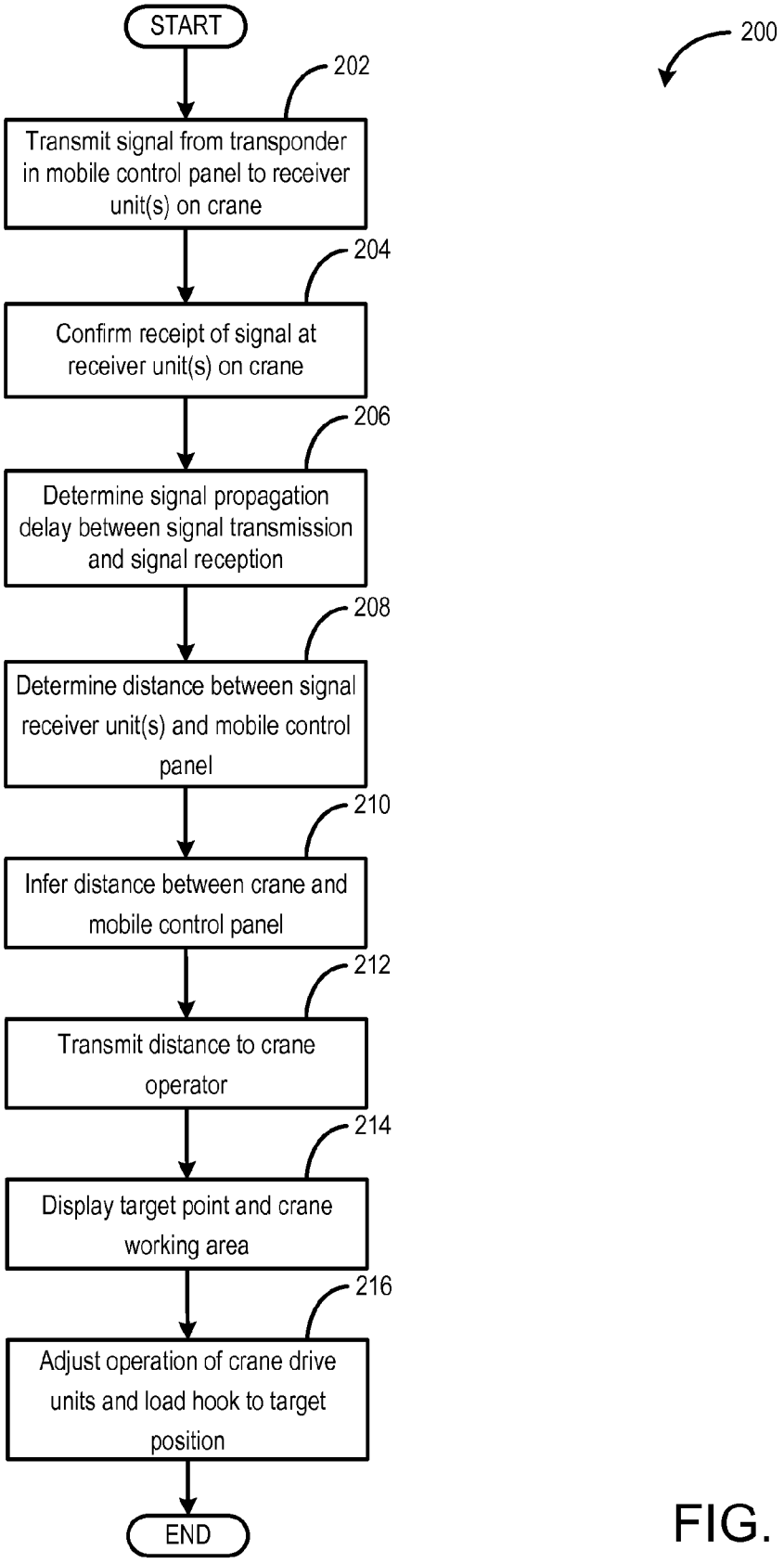
FIG. 2 shows a flow chart illustrating an example method that may be implemented for determining the position of the crane relative to a mobile control unit.

FIG. 2 shows a flow chart illustrating an example method 200 that may be implemented for determining the position of the crane relative to a mobile control unit so that the positioning of a load hook can be accordingly adjusted. Multiple transmitter/receiver units may be coupled to the crane. The mobile control panel may be variably positioned in the crane working area.

At 202, the method includes transmitting signals from a transponder in the mobile control panel to the one or more receiver unit(s) on the crane. At 204, the method includes, receiving, at the receiver units on the crane, the signals transmitted from the mobile control unit. At 206, a signal propagation delay between signal transmission (by the transponder) and signal reception (at the crane) is determined at the control unit. At 208, the method includes, based on the signal propagation delay, determining at the control unit, a distance between the signal receiver unit(s) and the mobile control panel. In one example, the distance may be determined based on the strength of the signal at the time of transmission relative to the time of signal receipt. In another example, the distance may be determined based on a time elapsed since the transmission of the signal relative to the time of signal receipt. At 210, a distance between the mobile control panel and the crane may be inferred from the distance determined at 208 (since the received units are coupled to the crane). Once the location of the crane is known, a crane operator may activate automatic movement of the crane drive units and the load hook towards a desired target position. For example, at 212, the method may include transmitting the determined distance to a crane operator. At 214, the method may include displaying to a crane operator, such as on a display arrangement, a crane working area and the position of a target point within the crane working area. In one example, the crane working area may be displayed to the crane operator and then based on operator input (e.g., received directly on the display arrangement), the target point may be displayed within the crane working area. At 216, based on input from the crane operator, the control unit may adjust the operation of the crane drive units to move the load hook to the target position. For example, based on the input, the crane drive units may be moved automatically or semi-automatically. This may include, as an example, adjusting the operation of the various motors and valves of the crane drive units. For example, in response to the transmitted and received signals, the control system may determine a target position for the load hook within a crane working area relative to a current position and accordingly control (e.g., increase) the output of a hydraulic pump and the position of a valve in a hydraulic line delivering hydraulic fluid to the crane drive unit. As a result of the actuation, there may be increased delivery of hydraulic fluid to the fluid line of the crane drive units, enabling the drive units to provide tractive force to the crane jib, allowing for the movement (e.g., telescoping or raising/lowering) of the crane jib, and movement of the load hook (e.g., raising or lowering). In an alternate example, an electric motor coupled to the crane drive unit may be operated in response to the signals received at the transponders and operation of the electric motor may provide the crane drive unit with sufficient tractive force for moving the crane jib and/or load hook. In this way, crane operation can be improved.

The invention claimed is:

1. A crane system, comprising:
- a crane with a jib coupled to a crane tower;
- a trolley movably mounted on the jib, the trolley including a load hook;
- one or more transponders positioned along the jib;
- a positioning device coupled to the crane tower including one or more crane drive units;
- a control unit coupled to the crane tower; and
- a portable control panel communicatively coupled to the control unit, the portable control panel including a signal transmitter and a touch display,
- wherein the portable control panel includes computer readable instructions stored on non-transitory memory for:
  - transmitting a signal from the signal transmitter to the one or more transponders, where the control unit receives an indication of receiving of the transmitted signal at the one or more transponders, and where the control unit estimates a distance between the portable control panel and the crane based on a time elapsed between the transmitting of the signal and receiving of the transmitted signal;
  - receiving, on the touch display, operator input indicative of a target position of the load hook; and
  - sending a signal to the positioning device to operate the one or more crane drive units to move the load hook to the target position.

2. The system of claim 1, wherein the portable control panel includes computer readable instructions stored on non-transitory memory for:
- displaying, to an operator, a crane map working area and the target position of the load hook within the crane map working area.

3. The system of claim 1, wherein the sending a signal includes sending a signal automatically without receiving additional operator input.

4. The system of claim 1, wherein the crane is one of a tower crane, a telescopic boom crane, and a harbour crane.

5. A crane system, comprising:
- a crane with a jib coupled to a crane tower;
- a trolley movably mounted on the jib, the trolley including a load hook;
- one or more transponders positioned along the jib;

a positioning device coupled to the crane tower including one or more crane drive units;

a control unit coupled to the crane tower; and a portable control panel communicatively coupled to the control unit, the portable control panel including a signal transmitter and a touch display, wherein the portable control panel includes computer readable instructions stored on non-transitory memory for:

transmitting a signal from the signal transmitter to the one or more transponders where the control unit receives an indication of receiving of the transmitted signal at the one or more transponders, and where the control unit estimates a distance between the portable control panel and the crane based on a time elapsed between the transmitting of the signal and receiving of the transmitted signal;

receiving, on the touch display, operator input indicative of a target position of the load hook; and sending a signal to the positioning device to operate the one or more crane drive units to move the load hook to the target position, wherein the positioning device further includes a GPS unit for estimating a GPS position of the crane tower relative to a position of the signal transmitter, and wherein a path to move the load hook to the target position is calculated based on the GPS position of the crane tower relative to the position of the signal transmitter.

* * * * *